US010100581B1

(12) United States Patent
Timte

(10) Patent No.: US 10,100,581 B1
(45) Date of Patent: Oct. 16, 2018

(54) ROTARY DRILL BIT

(71) Applicant: Michael Timte, Houston, TX (US)

(72) Inventor: Michael Timte, Houston, TX (US)

( * ) Notice: Subject to any disclaimer, the term of this patent is extended or adjusted under 35 U.S.C. 154(b) by 325 days.

(21) Appl. No.: 15/046,665

(22) Filed: Feb. 18, 2016

Related U.S. Application Data

(60) Provisional application No. 62/117,803, filed on Feb. 18, 2015.

(51) Int. Cl.
*E21B 10/62* (2006.01)
*E21B 10/12* (2006.01)
*E21B 10/10* (2006.01)

(52) U.S. Cl.
CPC ..... *E21B 10/12* (2013.01); *E21B 10/10* (2013.01); *E21B 10/62* (2013.01)

(58) Field of Classification Search
CPC ..... E21B 10/12; E21B 10/10; E21B 10/58; E21B 10/62
See application file for complete search history.

(56) References Cited

U.S. PATENT DOCUMENTS 2,201,219 A * 5/1940 Bell ..... E21B 10/12 175/334
5,535,839 A 7/1996 Brady
8,746,376 B2 6/2014 Vail et al.
2007/0079991 A1* 4/2007 Cooley ..... B23B 27/12 175/57
2013/0292185 A1* 11/2013 Knull ..... E21B 10/567 175/408

* cited by examiner

*Primary Examiner* — David J Bagnell
*Assistant Examiner* — Brandon M Duck
(74) *Attorney, Agent, or Firm* — Buskop Law Group, P.C.; Wendy Buskop

(57) ABSTRACT

A rotary dill bit with a drill bit head and a connecting portion, wherein the rotary bit is positioned and oriented for shearing a surface of a subterranean formation. The drill bit head is comprised of one or more cutting discs, wherein each cutting disc is rotatably mounted to at least one shaft between a pair of support structures with each cutting disc having a cutting disc edge extending outwardly beyond the support structures. The cutting discs have cutting inserts in an overlapping pattern, wherein each cutting insert comprises a projection extending from the cutting disc edge and angled from the cutting disc edge at a side rake and a front rake angle.

11 Claims, 3 Drawing Sheets

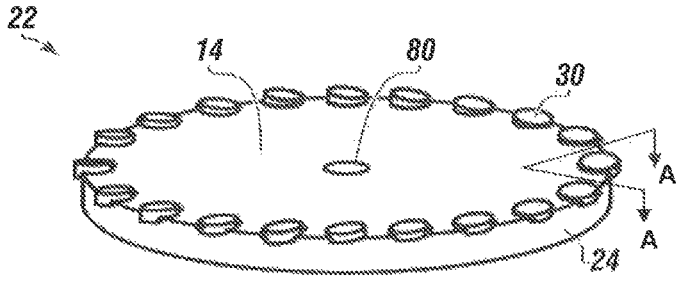
FIGURE 3
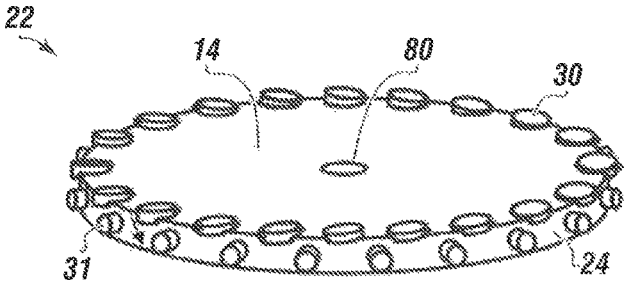
FIGURE 4
FIGURE 5
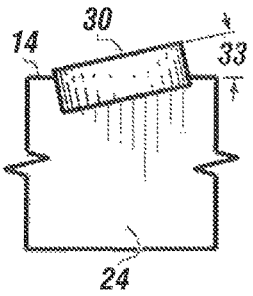
FIGURE 6
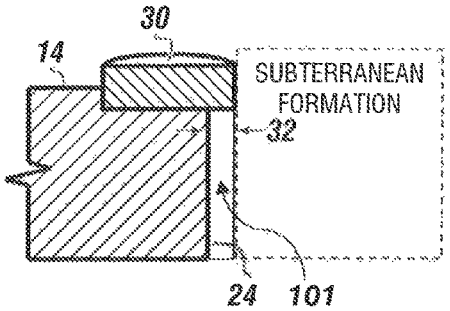

ROTARY DRILL BIT

CROSS REFERENCE TO RELATED APPLICATION

The current application claims priority to and the benefit of U.S. Provisional Patent Application Ser. No. 62/117,803 filed on Feb. 18, 2015, entitled "ROTARY DRILL BIT". This reference is incorporated in its entirety herein.

FIELD

The current embodiments generally relate to a rotary drill bit.

BACKGROUND

Boring into the earth is an important activity in many industries, such as mining, oil and gas drilling, prospecting and tunnel construction. A wide variety of methods and various different types of bits are available for this purpose. There are three contrasting approaches that are commonly used for boring into the earth in the oil and gas drilling, mining and construction industries, namely rotary shear drilling, roller cone drilling and percussion drilling.

The principal types of drill bits used in rotary drilling operations are roller bits and fixed cutter bits. In roller bits, roller cones are secured in sequences on the bit to form cutting teeth to crush and break up rock and earth material by compressive force as the bit is rotated at the bottom of the bore hole. In fixed cutter bits, Polycrystalline diamond compacts ("PDC") cutting elements on the bit act to cut or shear the earth material. The action of some flushing medium, such as fluid drilling mud or compressed air, is important in all types of drilling operations to cool the cutting elements and to flush or transport cuttings to the upper surface of the well. It is important to remove cuttings to prevent accumulations that will "ball up" or otherwise interfere with the crushing or cutting action of the bit and the cooling action is particularly important in the use of PCD cutters to prevent carbon transformation of the diamond material. In deep well drilling the circulation of drilling mud is contained in the wellbore hole and can be recaptured and controlled at the well surface.

A PDC cutting element typically includes a superabrasive diamond layer, also known as a diamond table. The diamond table is formed and bonded to a substrate using an ultra-high pressure, ultra-high temperature ("HPHT") process. The substrate is often brazed or otherwise joined to an attachment member, such as a stud or a cylindrical backing. A stud carrying the PDC can be used as a PDC cutting element when mounted to a bit body of a rotary drill bit by press-fitting, brazing, or otherwise securing the stud into a receptacle formed in the bit body. The PDC cutting element can also be brazed directly into a preformed pocket, socket, or other receptacle formed in the bit body. A rotary drill bit typically includes a number of PDC cutting elements affixed to the bit body.

A need exists for a drill bit head that is a variant to revolving cones on roller bits that reduces wear on the drill bit through the use of cutting discs with projections and angles that shear away the material being bored.

The present embodiments meet these needs.

BRIEF DESCRIPTION OF THE DRAWINGS

The detailed description will be better understood in conjunction with the accompanying drawings as follows:

FIG. 3 depicts cutting discs and cutting inserts according to one or more embodiments.

FIG. 4 depicts the cutting discs and cutting inserts according to one or more embodiments.

FIG. 5 depicts a perspective view of the cutting inserts according to one or more embodiments.

FIG. 6 depicts a cross section of the cutting inserts according to one or more embodiments.

Figure 1:
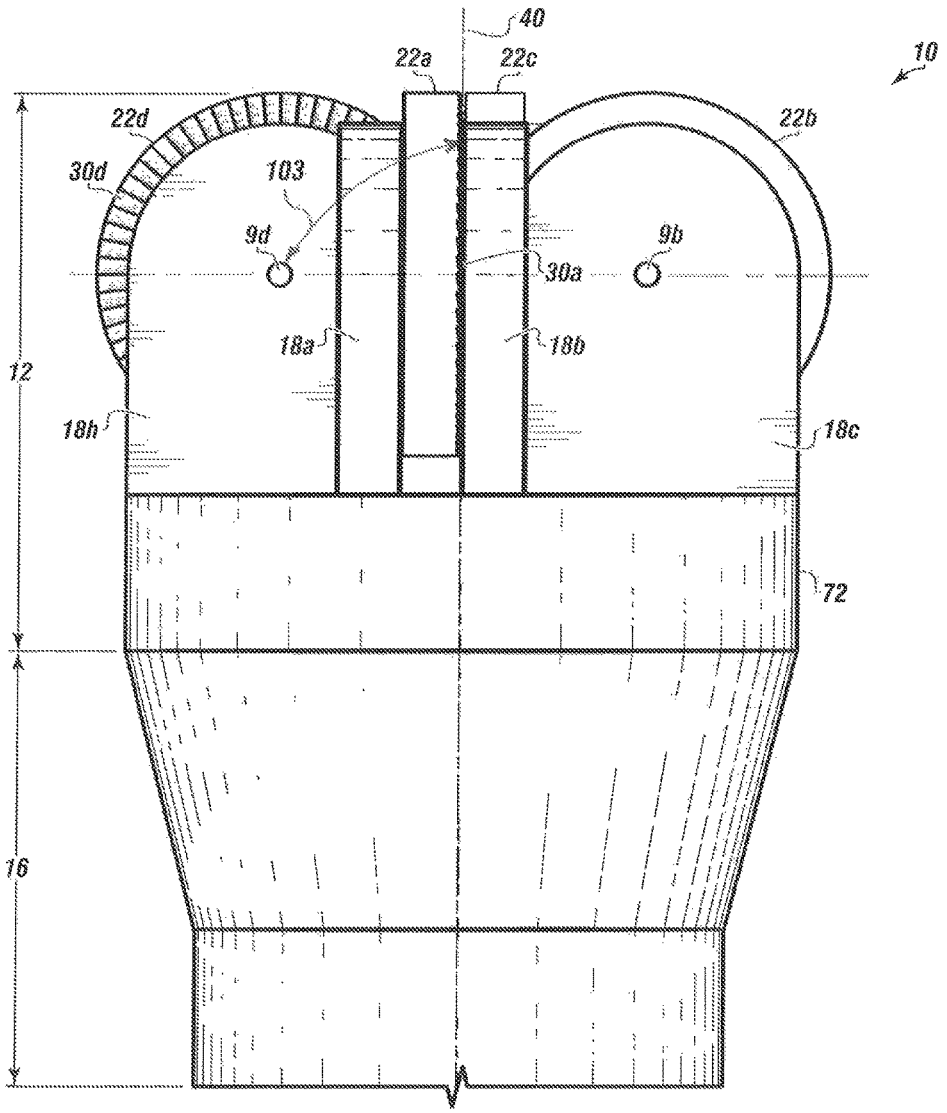
FIG. 1 depicts a side view of a rotary drill bit according to one or more embodiments.

The present embodiments are detailed below with reference to the listed Figures.

DETAILED DESCRIPTION OF THE EMBODIMENTS

Before explaining the present apparatus detail, it is to be understood that the apparatus is not limited to the particular embodiments and that they can be practiced or carried out in various ways.

The present embodiments generally relate to a rotary drill bit for drilling a borehole.

In embodiments, the rotary drill bit can comprise a drill bit head and a connecting portion.

The connecting portion, or rotary drill bit body, can engage a conveyance, such as a tubular, a string of tubulars, a drill pipe, or a drill string.

The present embodiments further relate to rotary drilling bits, such as polycrystalline diamond compacts ("PDC") rotary drilling bits, which utilize the shearing action of a traditional PDC bit with rotating discs to extend tool life similar to revolving cones on roller bits.

In embodiments, the drill bit head can be positioned and oriented for shearing a surface of a subterranean formation when the rotary drill bit is rotated under applied force against the subterranean formation.

The rotary drill bit can include plurality of support structures projecting longitudinally to the borehole from the drill bit head, wherein a pair of support structures of the plurality of support structures can be mounted offset from another pair of support structures of the plurality of support structures.

In embodiments, the drill bit head can have two support structures, which can support one cutting disc, to forty support structures, which can support twenty cutting discs.

In embodiments, the drill bit head can have one support structure, which can support one cutting disc, to twenty support structures, which can support twenty cutting discs.

The rotary drill bit can include plurality of cutting discs, wherein each cutting disc of the plurality of cutting discs has at least one cutting disc edge extending outwardly beyond the pair of support structures of the plurality of support structures.

In embodiments, the rotary drill bit can have at least one shaft, wherein each cutting disc of the plurality of cutting discs can be rotatably mounted to the at least one shaft, and wherein the at least one shaft can be supported between the pair of support structures of the plurality of support structures.

The support structures can be mounted in an offset orientation from other support structures. In embodiments, an offset angle from 50 degrees to 130 degrees can be used. The rotary drill bit can also comprise a reinforcing plate mounted to the drill bit head for engaging a conveyance for the tool as well as connecting to the plurality of support structures.

In embodiments, the rotary drill bit can have a plurality of cutting discs in an overlapping pattern. The Figures depict an exemplary embodiment with four overlapping cutting discs. Each cutting disc of the plurality of cutting discs need not fully overlap all other cutting discs, but can partially overlap one or more other cutting discs of the plurality of cutting discs. The cutting discs can be oriented with a centerline radial to the rotary drill bit body.

Persons having ordinary skill in the art can determine the number of cutting discs, the size limitations and the need of a specific application will be the only practical limitations to the number of cutting discs that can be used.

The term "shaft" as used herein can refer to the integral one piece body of the rotary drill bit or to a shaft-bearing assembly. The shaft can be cylindrical or it can be a combination of elliptical or concentric shapes. In embodiments, the shaft can have an annulus and an outer diameter from ½ of an inch to 26 inches. The wall of the shaft can be from ¼ of an inch to 14 inches in thickness. The shaft can be made of steel, coated steel, or another highly durable, high melt weight non-magnetic material. In embodiments, the shaft can be highly impact resistant and resistant to deforming under pressures up to 200,000 psi.

The rotary drill bit can include a plurality of cutting inserts installed in each cutting disc of the plurality of cutting discs, wherein each cutting insert of the plurality of cutting inserts comprises a projection forming a side rake angle and a front rake angle. In embodiments from 1 cutting insert to up to 100 cutting inserts can be installed on each cutting disc.

In embodiments, the cutting inserts can have a side rake angle up to 45 degrees in either direction for a cutting insert side rake and a front rake angle from −45 degrees to 45 degrees for a cutting insert front rake. Persons having ordinary skill in the art select the appropriate rake angles for a desired application, such as to change cutting orientation while drilling, facilitating directional drilling, and the like.

The term "cutting inserts" as used herein can refer to tungsten carbide cutting inserts, polycrystalline diamond compact cutting inserts, another comparable material known in the industry cutting inserts, and combinations thereof.

In embodiments, the cutting discs can comprise a tungsten carbide substrate matrix surface, alloy steel, or another comparable material as known to persons having ordinary skill in the art. The shape of the cutting inserts can be circular, elliptical, trapezoid, octagonal, square, or any polygonal shape.

The plurality of cutting discs can rotate while drilling enabling the plurality of cutting inserts to bore into the subterranean formation.

Alternatively, the rotary drill bit can comprise a plurality of cutting discs and a plurality of cutting inserts installed on a working surface.

Figure 2:
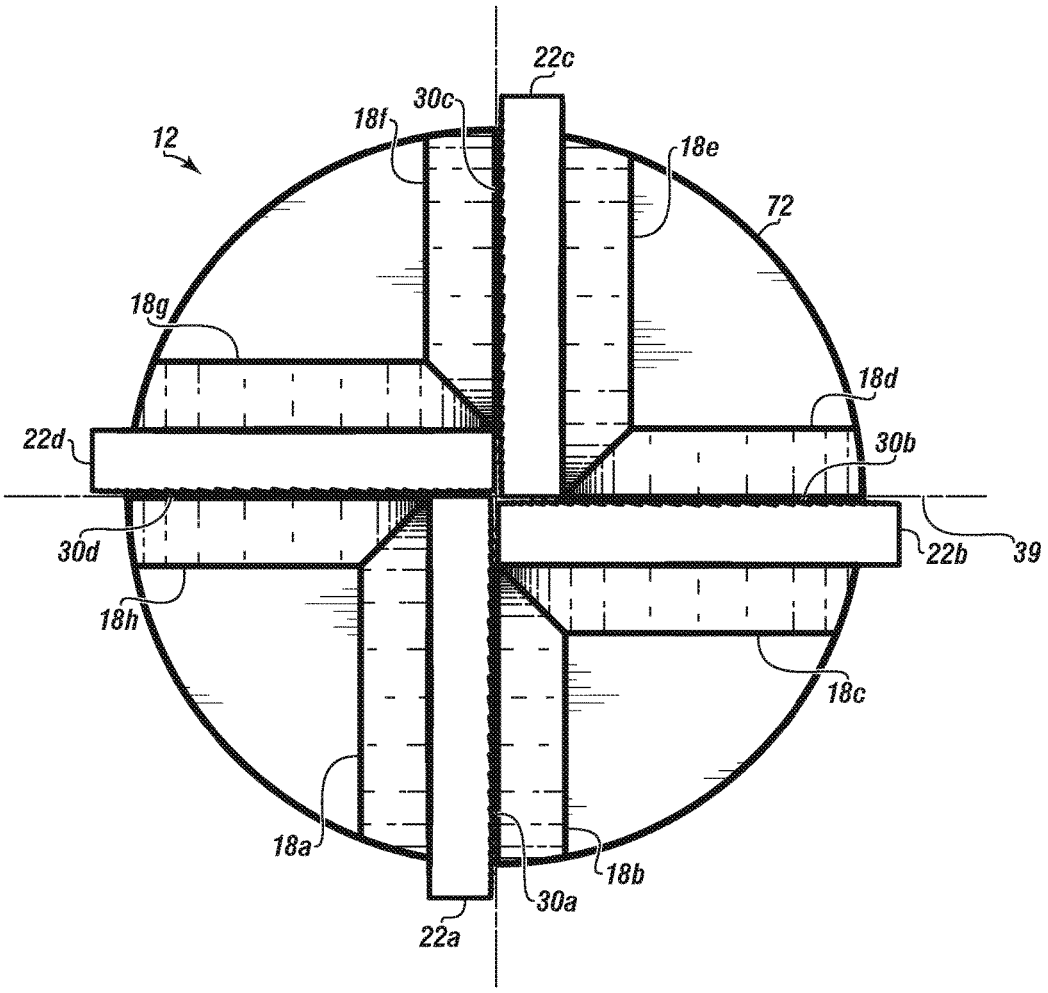
FIG. 2 depicts a top view of the rotary drill bit according to one or more embodiments.

Turning now to the Figures, FIG. 1 depicts a side view of the rotary drill bit according to one or more embodiments. FIG. 2 depicts a top view of the rotary drill bit according to one or more embodiments.

The embodiments relate to rotary drill bit 10 used to create a borehole. The rotary drill bit 10 can include a drill bit head 12 and a connecting portion 16 that can engage a conveyance, such as a pipe. The overall body material can be alloy steel or other comparable material. An alternative material can be a material consisting of tungsten carbide grains and a metallic binder matrix. In embodiments, the tungsten carbide grains can be imbedded in a ductile metal binder matrix of either cobalt or nickel.

The rotary drill bit 10 can have the drill bit head 12 with one or more working surfaces 14, which are shown in later Figures. Cutting inserts 30*a*, 30*b*, 30*c*, and 30*d* can be included on the working surfaces. Each cutting insert 30*a*, 30*b*, 30*c*, and 30*d* can have a projection 32, which is shown in FIG. 6, extending from the working surface and can be angled from the working surface forming a side rake angle and a front rake angle. Additionally, the projection can provide a relief space between a cutting disc edge 24, which is also shown in later Figures, and the formation being drilled.

The cutting insert front rake angle is defined as the angle that the plane of the cutting insert is inclined with respect to the plane of the working surface as measured radially to the working surface.

The drill bit head 12 can be positioned and oriented for shearing a surface of a subterranean formation when the rotary earth-boring tool is rotated under an applied force against the subterranean formation. Typically, the rotation occurs as torque is applied.

The drill bit head 12 can have one or more support structures 18*a*-18*h*, which can project longitudinally to the borehole from the drill bit head 12. Each pair of support structures can be mounted offset from another pair of support structures. The number of support structures is dependent upon the number of cutting discs. Support structures 18*a*, 18*c*, 18*e*, and 18*g* can serve alone or in addition to support structures 18*b*, 18*d*, 18*f*, and 18*h* to support the cutting discs. The support structures can be connected to the cutting discs 22*a*, 22*b*, 22*c*, and 22*d* by a shaft 9*b* and 9*d* upon which the cutting discs can rotate.

In embodiments, the rotary drill bit 10 can include one or more cutting discs. Each cutting disc can be rotatable and mounted between a pair of support structures. For example, support structures 18*a* and 18*b* support cutting disc 22*a*. Each cutting disc can have one or more cutting disc edges extending outwardly beyond the pair of support structures. The ratio of distance from the axis of rotation of a cutting disc to a reinforcing plate 72 is greater than 50 percent of the diameter of the cutting disc.

In embodiments, each cutting disc can include cutting inserts, comprised of tungsten carbide, polycrystalline diamond compact or another comparable material, formed on the surface with the projections extending from the cutting disc edge 24. The support structures can be mounted offset from each other pair of support structures by an offset angle from about 50 degrees to about 130 degrees. The offset angle is defined as the angle between the radial axis 39 of the drill bit head and the axis of rotation of a cutting disc.

In embodiments, a fixed camber angle 103 can be used to mount each cutting disc between the pair of support structures thereby allowing the cutting disc to have a cutting disc forward rake of about 45 degrees or a cutting disc back rake of about 45 degrees, which is depicted at 90 degrees. The fixed camber angle 103 is defined as the angle between the longitudinal axis 40 of the drill bit head and the axis of rotation of each cutting disc.

In embodiments, the rotary drill bit can include one or more cutting inserts installed in one of the cutting disc edges. Each cutting insert can have a projection that extends from the cutting disc edge and can be angled from the cutting disc edge. The angled projections create a side rake angle, which is less than 45 degrees in either direction, forming a side rake and create a front rake angle forming a forward rake. These angles (side rake angle and front rake angle) are formed simultaneously.

In embodiments, the plurality of cutting inserts extend from each cutting disc of the plurality of cutting discs at the side rake angle up to 45 degrees in either direction for a cutting insert side rake and at the front rake angle from −45 degrees to 45 degrees for a cutting insert front rake In embodiments, the rotary drill bit can have one or more cutting discs.

In embodiments, the rotary drill bit can have four cutting discs. In addition, each cutting disc can be equipped with as little as one and up to 100 cutting inserts.

In embodiments, the cutting discs can be presented in an overlapping pattern. The cutting discs simultaneously rotate while drilling thereby enabling the cutting inserts to bore into a subterranean formation. In the overlapping pattern for four cutting discs, a second cutting disc extends partially over the first cutting disc at a right angle.

A third cutting disc extends partially over the second cutting disc at a right angle, but does not extend over the first cutting disc. A fourth cutting disc extends partially over the third cutting disc at a right angle, but does not extend over the second cutting disc. This method of overlapping the cutting discs allow the working surface and the cutting inserts of all cutting discs to be presented to the borehole in an orientation radial to the axis of rotation of the rotary drill bit.

In embodiments, the drill bit head can comprise four cutting discs aligned in a cross configuration with a centerline of each cutting disc aligned radially from a center of a rotary drill bit body.

In embodiments, the rotary drill bit 10 can include the reinforcing plate 72 with a borehole mounted to the drill bit head 12 opposite the cutting discs for engaging a conveyance and for connecting to all support structures on a side opposite the conveyance.

FIG. 3 and FIG. 4 depict various embodiments of the cutting inserts and cutting discs.

The cutting inserts can be composed of polycrystalline diamond material, tungsten carbide or another comparable material.

The cutting discs can be composed of a tungsten carbide granule and metallic binder matrix material or of alloy steel or of any other comparable material.

In FIG. 3, cutting inserts 30 (see detailed view of A-A in FIG. 5) can be affixed to cutting disc 22 with a projection, which extends past the cutting disc edge 24. The working surface 14 is the top surface of the cutting disc 22 and serves as a plane to which the cutting front rake angle and the cutting side rake angle are measured. The shaft on which the cutting disc rotates is fitted through a hole 80, which can be located in the center of the cutting disc.

By using the style of cutting disc depicted in FIG. 3, the cutting action of the rotary drill bit would most closely resemble that of a traditional PDC drill bit because the cutting action results from the shearing action of the rotary drill bit cutting inserts 30 as it rotates.

In FIG. 4, a cutting disc 22 similar to that in FIG. 3 is depicted. In FIG. 4, compression cutting inserts 31 are included. These compression cutting inserts 31 can be mounted into the cutting disc edge 24 and protrude from the cutting disc edge 24 by the same projection as the cutting inserts 30.

The working surface 14 is the top surface of the cutting disc 22 and serves as a plane to which the cutting front rake angle and the cutting side rake angle are measured. The shaft on which the cutting disc rotates is fitted through a hole 80, which can be located in the center of the cutting disc.

The style of cutting disc depicted in FIG. 4 represents the hybrid cutting action of both roller cone bits and PDC bits. The shearing action of the cutting inserts 30, created by the rotation of rotary drill bit, is similar to the cutting action of a PDC bit. The crushing or pulverizing action of the compression cutting inserts 31, created by both the rotation of and the weight on the rotary drill bit resembles that of a roller cone bit.

Each cutting insert 30 extends from the cutting disc 22 in a projection 32, shown in FIG. 6, at a cutting insert side rake angle, which can be up to 45 degrees in either direction to form the cutting insert side rake and at a cutting insert front rake angle from 0 degrees to 45 degrees. A positive or negative front rake angle can be used in conjunction with the side rake angle to facilitate slow rotation of the cutting discs. Rotation of the cutting disc allows all cutting inserts to cut the bottom of the borehole.

In embodiments, the cutting inserts can take on any shape and are not necessarily circular as they are depicted in the Figures.

FIG. 5 and FIG. 6 depict the cutting inserts, shown as A-A in. FIG. 3, according to one or more embodiments in perspective and cross section views respectively.

In FIG. 5, the cutting insert 30 is located on the cutting disc edge 24 at a cutting insert side rake angle 33 away from the working surface 14. The cutting insert side rake angle 33 can vary up to about 45 degrees in either direction. Each cutting insert 30 on a cutting disc can have the same cutting insert rake angle or the cutting insert rake angle can vary from one cutting insert to the next. If the cutting insert rake angles vary, the cutting insert rake angles can vary in discernable pattern or not.

The cutting insert side rake angle 33 is defined as the angle that the plane of the cutting insert is inclined with respect to the plane of the working surface as measured tangentially to the working surface.

In FIG. 6, the cutting insert 30 is located on the cutting disc edge 24 at a projection length 32 away from the cutting disc edge 24 and the working surface 14. The projection length 32 can vary from 0 percent to 50 percent of the width of the cutting insert 30. Each cutting insert 30 on the cutting disc can have the same projection length 32 or the projection lengths can vary from one cutting insert 30 to the next. If the projection lengths 32 vary, the projection lengths 32 can vary in discernable pattern or not.

While these embodiments have been described with emphasis on the embodiments, it should be understood that within the scope of the appended claims, the embodiments might be practiced other than as specifically described herein.

Additionally, the projection can provide a relief space 101 between a cutting disc edge 24, and the subterranean formation being drilled.

What is claimed is:

1. A rotary drill bit for drilling a borehole comprising:

a. a drill bit head, a connecting portion for engaging a conveyance, wherein the drill bit head is positioned and oriented for shearing a surface of a subterranean formation when the rotary drill hit is rotated under applied force against the subterranean formation;

b. a plurality of support structures projecting longitudinally to the borehole from the drill bit head; wherein a pair of support structures of the plurality of support structures is mounted offset from another pair of support structures of the plurality of support structures;

c. a plurality of cutting discs, wherein each cutting disc of the plurality of cutting discs has at least one cutting disc edge extending outwardly beyond the pair of support structures of the plurality of support structures, and wherein each cutting disc is rotatable and mounted between the pair of support structures;

d. at least one shaft, wherein each cutting disc of the plurality of cutting discs is rotatably mounted to the at least one shaft, and wherein the at least one shaft is supported between the pair of support structures of the plurality of support structures; and e. a plurality of cutting inserts installed in each cutting disc of the plurality of cutting discs, wherein each cutting insert of the plurality of cutting inserts consists of a projection forming a side rake angle and a front rake angle, and wherein the projection defines a relief space between the projection, the working surface, and the subterranean formation using the side rake angle and the front rake angle simultaneously; and wherein the plurality of cutting discs rotate while drilling enabling the plurality of cutting inserts to bore into the subterranean formation.

2. The rotary drill bit of claim 1, wherein each cutting disc of the plurality of cutting discs comprise a member of the group consisting of: a tungsten carbide substrate matrix surface and alloy steel.

3. The rotary drill bit of claim 1, wherein the plurality of cutting inserts are composed of a member of the group consisting of: polycrystalline diamond compact and tungsten carbide.

4. The rotary drill bit of claim 1, wherein each cutting insert of the plurality of cutting inserts extends from each cutting disc of the plurality of cutting discs at the side rake angle up to 45 degrees in either direction for a cutting insert side rake and at the front rake angle from −45 degrees to 45 degrees for a cutting insert front rake.

5. The rotary drill bit of claim 1, Wherein the drill bit head comprises four cutting discs presented in an overlapping pattern.

6. The rotary drill hit of claim 5, wherein the overlapping pattern for four cutting discs has a first cutting disc, a second cutting disc extending partially over the first cutting disc at a right angle, a third cutting disc extending partially over the second cutting disc at a right angle but not extending over the first cutting disc, and a fourth cutting disc extending partially over the third cutting disc but not the second cutting disc at a right angle.

7. The rotary drill bit of claim 1, wherein the drill bit head has from two support structures supporting one cutting disc to forty support structures supporting twenty cutting discs.

8. The rotary drill bit of claim 1, wherein the drill bit head has from two support structures supporting one cutting disc to twenty support structures supporting cutting discs.

9. The rotary drill bit of claim 1, wherein each pair of support structures of the plurality of support structures are mounted offset from another pair of support structures by an offset angle from 50 degrees to 130 degrees.

10. The rotary drill bit of claim 1, comprising a reinforcing plate mounted to the drill bit head opposite the plurality of cutting discs for engaging the conveyance and for connecting to the plurality of support structures on a side opposite the conveyance.

11. The rotary drill hit of claim 1, comprising a fixed camber angle for each cutting disc of the plurality of cutting discs between the pair of support structures of the plurality of support structures allowing each cutting disc of the plurality of cutting discs to have the forward rake angle or the side rake angle adapted to change cutting orientation while drilling based on changes in the subterranean formation.

* * * * *